US005728229A

United States Patent [19]

Després

[11] Patent Number: 5,728,229

[45] Date of Patent: Mar. 17, 1998

[54] TEST PROBE CLEANER

[75] Inventor: Alain Després, Gatineau, Canada

[73] Assignee: Newbridge Networks Corporation, Kanata, Canada

[21] Appl. No.: 642,844

[22] Filed: May 6, 1996

[30] Foreign Application Priority Data

May 4, 1995 [GB] United Kingdom ..... 9509055

[51] Int. Cl.[6] ..... B08B 1/00

[52] U.S. Cl. ..... 134/32; 134/23; 134/42; 15/21.1; 15/77; 15/88.1

[58] Field of Search ..... 15/21.1, 77, 88.1; 134/32, 23, 42; 436/49

[56] References Cited

U.S. PATENT DOCUMENTS

| | | | |
|---|---|---|---|
| 3,449,163 | 6/1969 | Mobius et al. | 134/32 |
| 3,873,365 | 3/1975 | Dapolito et al. | 134/140 |
| 4,162,552 | 7/1979 | Winter | 15/104.92 |
| 4,622,076 | 11/1986 | Ling | 134/32 |
| 5,030,293 | 7/1991 | Rich et al. | 134/32 |
| 5,044,036 | 9/1991 | Fujimoto et al. | 15/88.1 |
| 5,124,736 | 6/1992 | Yamamoto et al. | 354/325 |
| 5,498,294 | 3/1996 | Matsushita et al. | 134/6 |

*Primary Examiner*—Long V. Le
*Attorney, Agent, or Firm*—Marks & Clerk

[57] ABSTRACT

A test probe cleaning apparatus for a test probe fixture having a multitude of test probes protruding therefrom, comprises a pan for containing a cleaning fluid, an upstanding brush in the pan, and a carriage for holding an inverted test probe fixture. The carriage is movable over the brush so that the test probes can be passed through the brush to be cleaned thereby. In a preferred embodiment, an arrangement is provided for gauging the height of the test probes. The height of the carriage can then be adjusted to match the height of the test probes. The apparatus simplifies the cleaning of test probes in the high technology industry.

8 Claims, 1 Drawing Sheet

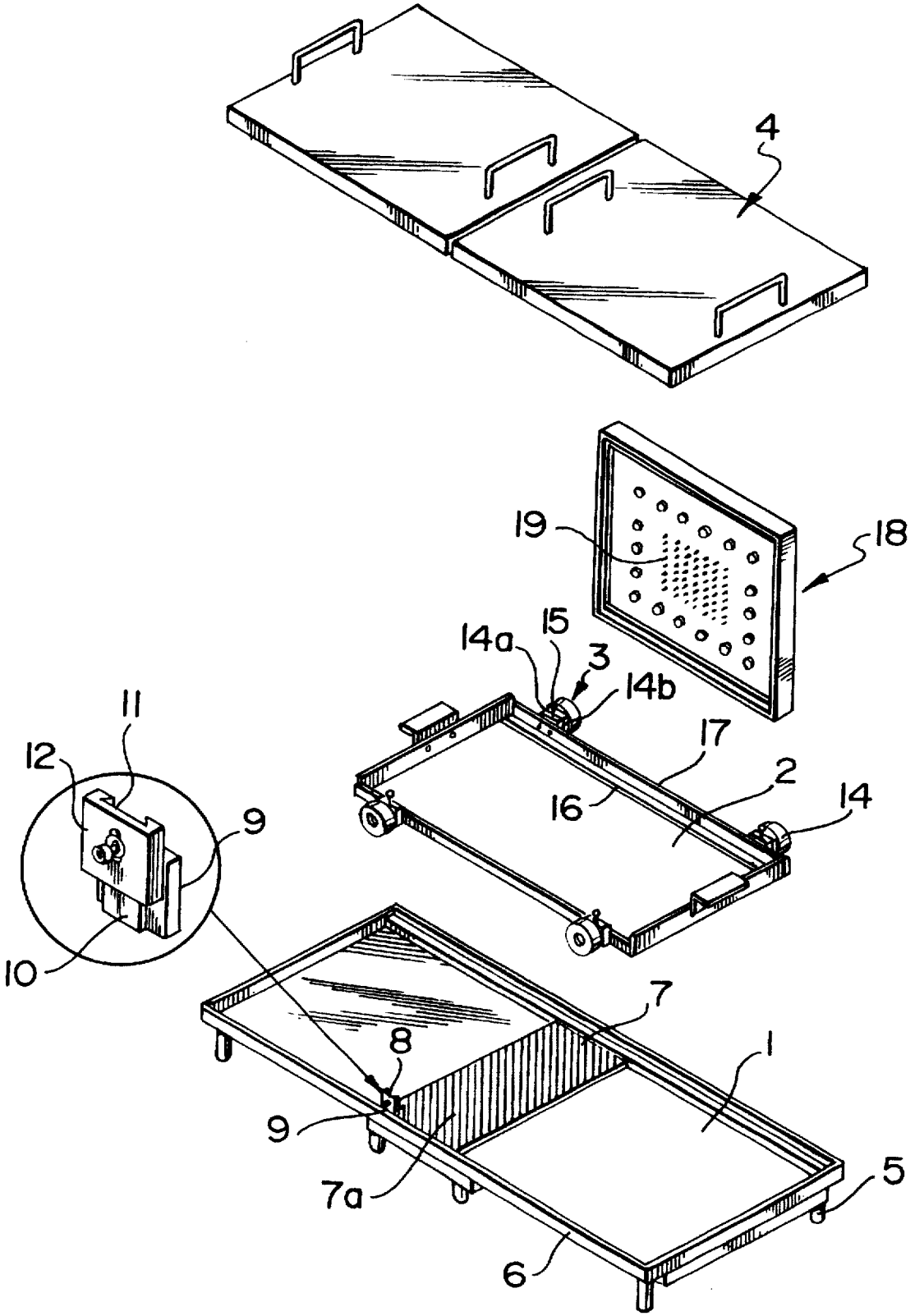
4
19
18
14a
15
3
14b
11
12
17
2
16
14
9
10
7
8
1
9
7a
5
6

TEST PROBE CLEANER

BACKGROUND OF THE INVENTION

This invention relates to an apparatus for cleaning test probes on test fixtures, for example, in the high technology industry.

Test Fixtures in the high technology industry are used to verify that a manufactured product is fully operational. A test fixture simulates the normal working environment of the product. The fixture has a multitude of test probes for making contact with the product. These probes need to be cleaned after every production test batch to prevent any contaminants from permanently damaging them.

Test probe manufacturers recommend that each probe be removed and grouped into a pack of about 50 pieces, and that the probes then be cleaned with a tooth brush using a special cleaning and lubricant liquid. This causes a major problem because some test fixtures have more than a thousand probes. Some of the probes are of a different type. Some are the same types with a different spring force. Removing them is therefore a very time-consuming operation.

An object of the invention is to alleviate the aforementioned problems of the prior art.

SUMMARY OF THE INVENTION

According to the present invention there is provided a test probe cleaning apparatus for cleaning a test probe fixture having a multitude of protruding test probes having a height, comprising a shallow pan for containing a cleaning fluid, upstanding brush means mounted in said pan so as to be immersed in said cleaning fluid, said brush means extending across said pan, a carriage movable back and forth over said brush means, said carriage comparing an open frame with means for supporting a test fixture such that the probes extend downwardly through said open frame toward the pan, means for gauging the height of the test probes, and means for adjusting the height of said carriage above the pan to match the height of the test probes, whereby as said carriage is moved back and forth said test probes are brushed by said brush means while in said cleaning fluid and thereby cleaned.

The invention thus obviates the need to remove the probes from the test fixture, resulting in substantial time savings and also prolonging the life of the test probes.

BRIEF DESCRIPTION OF THE DRAWINGS

The invention will now be described in more detail, by way of example only, with reference to the accompanying drawing, in which the single FIGURE is an exploded view of a test probe cleaning apparatus in accordance with the invention.

DESCRIPTION OF THE PREFERRED EMBODIMENTS

The test probe cleaning apparatus comprises a shallow pan 1 containing a cleaning fluid, a carriage 2 running on wheels 3 in the pan 1, and a cover 4. A suitable cleaning fluid is, for example, DeoxIt™ DL5 mnaufactured by Caig Laboratories Inc. of San Diego, Calif.

The pan 1 is in the form of a shallow rectangular tray mounted on legs 5 and having short sidewalls 6. A raised rectangular brush member 7 providing a multitude of cleaning bristles **7*a* is attached to the middle of the tray 1. The brush member 7 has nylon bristles 7*a*** of 10 thousands of an inch in diameter, 0.750" high, and medium hardness. A suitable brush member can be obtained from Wackid radio.

A measuring gauge 8 is located on one of the sidewalls adjacent the brush member 7. The measuring gauge comprises an upstanding fixed bar 9 welded to the sidewall of the pan 1 and has a trapezoidal section tongue 10 mating with a matching groove 11 in channel bar 12 sliding thereon. Set screw 13 allows the channel bar 12 to be located at any desired vertical position relative to the upstanding bar 9.

The carriage 2 travels back and forth on the wheels 3 in the pan 1. The wheels 3 are mounted on adjustable mounts 14, which allow their height to be adjusted. The mounts 14 comprise an outer block **14*a* and an inner block 14*b* coupled together with a tongue-and-groove arrangement similar to that employed for the measuring gauge except that the groove has a blind end at the top. Set screw 15** passes through the blind end to engage the sliding tongue inside the groove, thereby permitting the height of the wheels to be set as desired.

The carriage 2 has an inwardly directed ledge 16 along the bottom edge of its long sidewalls 17. In use, test fixture 18 having test probes 19 is placed in the carriage 2 so as to be seated on the ledges 16.

Cover 4 can be placed over the whole assembly when not in use.

In order to use the apparatus, the operator first places the test fixture upside down in the pan 1 and measures its height by adjusting the sliding channel bar 12 on the measuring gauge 8. The operator then places the carriage 2 in the pan 1 and adjusts the height of the wheels with the adjustable mounts 14 to ensure that the bottom of the carriage is level with the top of the test probes. Once this is done, the test fixture is placed upside down in the carriage 2, which is then moved back and forth by hand so that the test probes pass over the bristles of brush 7 in the cleaning fluid contained in the pan 1.

It is only necessary to move the carriage back-and-forth by hand for about 30 seconds to completely clean the probes so that they are ready for further use.

The invention thus provides a simple and effective solution to the problem of cleaning test probes. It is no longer necessary remove the probes for cleaning. The life of the probes is also prolonged because they are cleaned in situ.

I claim:

1. A test probe cleaning apparatus for cleaning a test probe fixture having a multitude of protruding test probes having a height, comprising:

a pan for containing a cleaning fluid;

upstanding brush means mounted in said pan so as to be immersed in said cleaning fluid, said brush means extending across said pan;

a carriage movable back and forth over said brush means, said carriage having an open frame with means for supporting a test fixture such that the probes extend downwardly through said open frame toward the pan; means for gauging the height of the test probes; and means for adjusting the height of said carriage above the pan to match the height of the test probes relative to said pan;

whereby as said carriage is moved back and forth so that said test probes are brushed by said brush means while in said cleaning fluid and thereby cleaned.

2. A test probe cleaning apparatus as claimed in claim 1, wherein said carriage is mounted on wheels that travel back and forth in said pan.

3. A test probe cleaning apparatus as claimed in claim 2, wherein said wheels are mounted on vertically adjustable mounts.

4. A test probe cleaning apparatus as claimed in claim 3, wherein said wheels are mounted on sliding blocks adjustable in height by means of set screws.

5. A test probe cleaning apparatus as claimed in claim 1, wherein said means for gauging comprises an upstanding bar attached to a sidewall of the pan, a second bar slidable along said upstanding bar, and a set screw for locating said sliding bar vertically relative to said upstanding bar.

6. A test probe cleaning apparatus as claimed in claim 5, wherein said bars comprise an interlocking tongue-and-groove arrangement.

7. A method of cleaning a test fixture having a multitude of protruding probes having a height, comprising the steps of:

providing a shallow pan containing a cleaning fluid;

providing upstanding brush means in said pan so as to be immersed in said cleaning fluid, said brush means extending across said pan;

providing a carriage having an open frame movable back and forth in said pan over said upstanding brush means;

measuring the height of said test probes;

adjusting the height of said carriage in said pan to match the height of said test probes relative to said pan;

placing a test fixture in said carriage such that said test probes protrude through said open frame toward said pan; and moving said carriage back and forth over said upstanding brush means in said pan such that said test probes are brushed by said brush means while in said cleaning fluid and thereby cleaned.

8. A method as claimed in claim 7, wherein the carriage is moved back-and-forth in said pan on wheels.

* * * * *